US007600729B2

(12) United States Patent
Valin

(10) Patent No.: US 7,600,729 B2
(45) Date of Patent: Oct. 13, 2009

(54) UNIVERSAL GOLF BAG SUPPORT

(76) Inventor: Norman A. Valin, 717 Elizabeth Dr., Wood Dale, IL (US) 60191-2323

( * ) Notice: Subject to any disclaimer, the term of this patent is extended or adjusted under 35 U.S.C. 154(b) by 0 days.

(21) Appl. No.: 10/950,833

(22) Filed: Sep. 27, 2004

(65) Prior Publication Data

US 2006/0065792 A1 Mar. 30, 2006

(51) Int. Cl.
*F16B 45/00* (2006.01)

(52) U.S. Cl. ..... 248/304; 248/308; 248/305; 248/294.1; 211/70.2

(58) Field of Classification Search ..... 248/304, 248/308, 303, 301, 96, 95, 100, 339, 294.1, 248/290.1; 211/70.2, 99, 100
See application file for complete search history.

(56) References Cited

U.S. PATENT DOCUMENTS

| | | | | | |
|---|---|---|---|---|---|
| 61,590 | A | * | 1/1867 | Whitmarsh et al. | 248/294.1 |
| 389,326 | A | * | 9/1888 | Seibert | 211/99 |
| 461,291 | A | * | 10/1891 | Timmerman | 248/100 |
| 470,480 | A | * | 3/1892 | Draper | 211/65 |
| 587,945 | A | * | 8/1897 | Elliott | 410/3 |
| 830,994 | A | * | 9/1906 | Hatin | 248/97 |
| 914,989 | A | * | 3/1909 | Sucher | 248/113 |
| 926,071 | A | * | 6/1909 | Milholland | 248/308 |
| 1,015,076 | A | * | 1/1912 | Robert | 211/99 |
| 1,183,124 | A | * | 5/1916 | Schwalen | 248/95 |
| 1,373,460 | A | * | 4/1921 | Striker et al. | 211/99 |
| 1,376,546 | A | * | 5/1921 | Jeep | 248/304 |
| 1,401,532 | A | * | 12/1921 | Geer | 211/99 |
| 1,515,690 | A | * | 11/1924 | Marion | 248/306 |
| 1,616,013 | A | * | 2/1927 | Freed | 24/697.2 |
| 1,817,962 | A | * | 8/1931 | Breuer | 248/308 |
| 1,892,687 | A | * | 1/1933 | Teufel | 211/99 |
| 2,235,182 | A | * | 3/1941 | Weston | 248/100 |
| 2,423,531 | A | * | 7/1947 | Theis | 224/182 |
| 2,492,701 | A | * | 12/1949 | Kirk | 211/100 |
| 3,289,985 | A | * | 12/1966 | Sheiman | 248/95 |
| 3,452,957 | A | * | 7/1969 | Zuelsdorf | 248/318 |
| 4,051,953 | A | * | 10/1977 | Shoaf | 211/119.1 |
| 4,628,893 | A | * | 12/1986 | Shaw, III | 124/23.1 |
| 4,998,694 | A | * | 3/1991 | Barteaux | 248/100 |
| 5,322,256 | A | * | 6/1994 | Kanwischer | 248/312 |
| 6,289,618 | B1 | * | 9/2001 | Kump et al. | 40/657 |
| 2002/0179793 | A1 | * | 12/2002 | Wang | 248/308 |

* cited by examiner

*Primary Examiner*—Kimberly T Wood
(74) *Attorney, Agent, or Firm*—McDermott Will & Emery, LLP

(57) ABSTRACT

A golf bag support is provided for supporting a golf bag in a golf cart. The golf bag support includes a bracket, first and second connectors, and an elongated arm. The elongated arm has a hook extending from a distal end of the elongated arm, and a transverse member extending from a proximal end of the elongated arm. The transverse member is rotatably supported by the first and second connectors. The hook is adapted to secure the golf bag at an angle in the golf cart to aid in the removal and insertion of golf clubs in the golf bag.

11 Claims, 3 Drawing Sheets

UNIVERSAL GOLF BAG SUPPORT

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates to a holder for a golf bag, and more particularly to a bracket for supporting a golf bag in a golf cart.

BACKGROUND OF THE INVENTION

Holders for supporting golf bags, including those for supporting golf bags in golf carts, are well known in the art. Such golf bag holders generally comprise a strap having a fastener to fixedly support the golf bag in a vertical position in the golf cart. While golf bag holders according to the prior art provide a number of advantageous features, they nevertheless have certain limitations. The present invention seeks to overcome certain of these limitations and other drawbacks of the prior art, and to provide new features not heretofore available.

SUMMARY OF THE INVENTION

The present invention generally provides a support for supporting a golf bag at an angle in a golf cart. According to one embodiment, the golf bag support has a connector rotatably supporting an elongated arm. The elongated arm has a proximal end and a distal end. A hook extends from the distal end of the elongated arm to connect to the golf bag, and a transverse member extends from the proximal end of the elongated arm. In such an embodiment the transverse member of the elongated arm is rotatably supported by the connector.

According to another embodiment, the transverse member comprises a shaft depending from the proximal end of the elongated arm. The transverse member may also comprise a "T" shaped bar depending from the proximal end of the elongated arm. In such an embodiment the "T" shaped bar portion of the elongated arm is rotatably supported by the first and second connectors.

According to another embodiment, the hook has a first arcuate portion extending in a first direction transverse to the elongated arm, and a second arcuate portion extending in a second opposing direction transverse to the elongated arm. The hook may also have a third portion extending in a direction toward the elongated arm.

According to another embodiment, the golf bag support has a latch in association with the hook. The latch closes an opening to the hook to assist in retaining the golf bag connected in the hook. The latch is generally moveable from a first position, wherein the opening to the hook is open, to a second position, wherein the opening to the hook is closed to retain the golf bag connected in the hook. In one embodiment the latch is automatically closable.

According to another embodiment, the connector comprises a first connector and a second connector distal the first connector. When two connectors are utilized the transverse member is rotatably supported within the first and second connectors. In one embodiment, the first and second connectors comprise eye bolts.

According to another embodiment, the transverse member of the golf bag support is secured in place with the use of retainers. A first retainer is provided on the transverse member adjacent the first connector, and a second retainer is provided on the transverse member adjacent the second connector.

According to another embodiment, the golf bag support also has a bracket, and the first and second connectors extend from the bracket, even though the connectors are not necessarily connected to the bracket. In another embodiment, a second bracket may be included. In such an embodiment, the first bracket is positioned on a first surface of the golf cart, and the second bracket is positioned on a second opposing surface of the golf cart to assist in supporting the golf bag support on the golf cart.

According to yet another embodiment, the golf bag support has a coupling extending from the bracket. The coupling engages the elongated arm in a first position to secure the elongated arm during periods of non-use of the golf bag support.

Other features and advantages of the invention will be apparent from the following examples in the specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

While this invention is susceptible of embodiment in many different forms, and will herein be described in detail, preferred embodiments of the invention are disclosed with the understanding that the present disclosure is to be considered as exemplifications of the principles of the invention and are not intended to limit the broad aspects of the invention to the embodiments illustrated.

Figure 1:
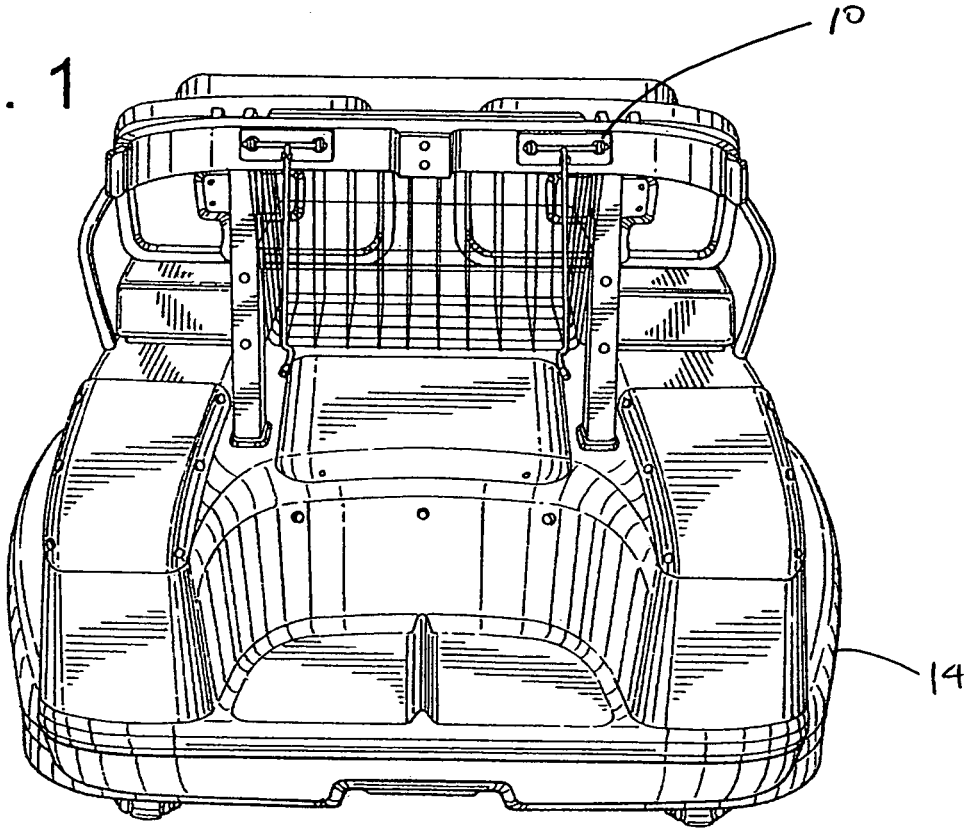
FIG. 1 is a rear perspective view of a golf bag support connected to a golf cart.
Figure 2:
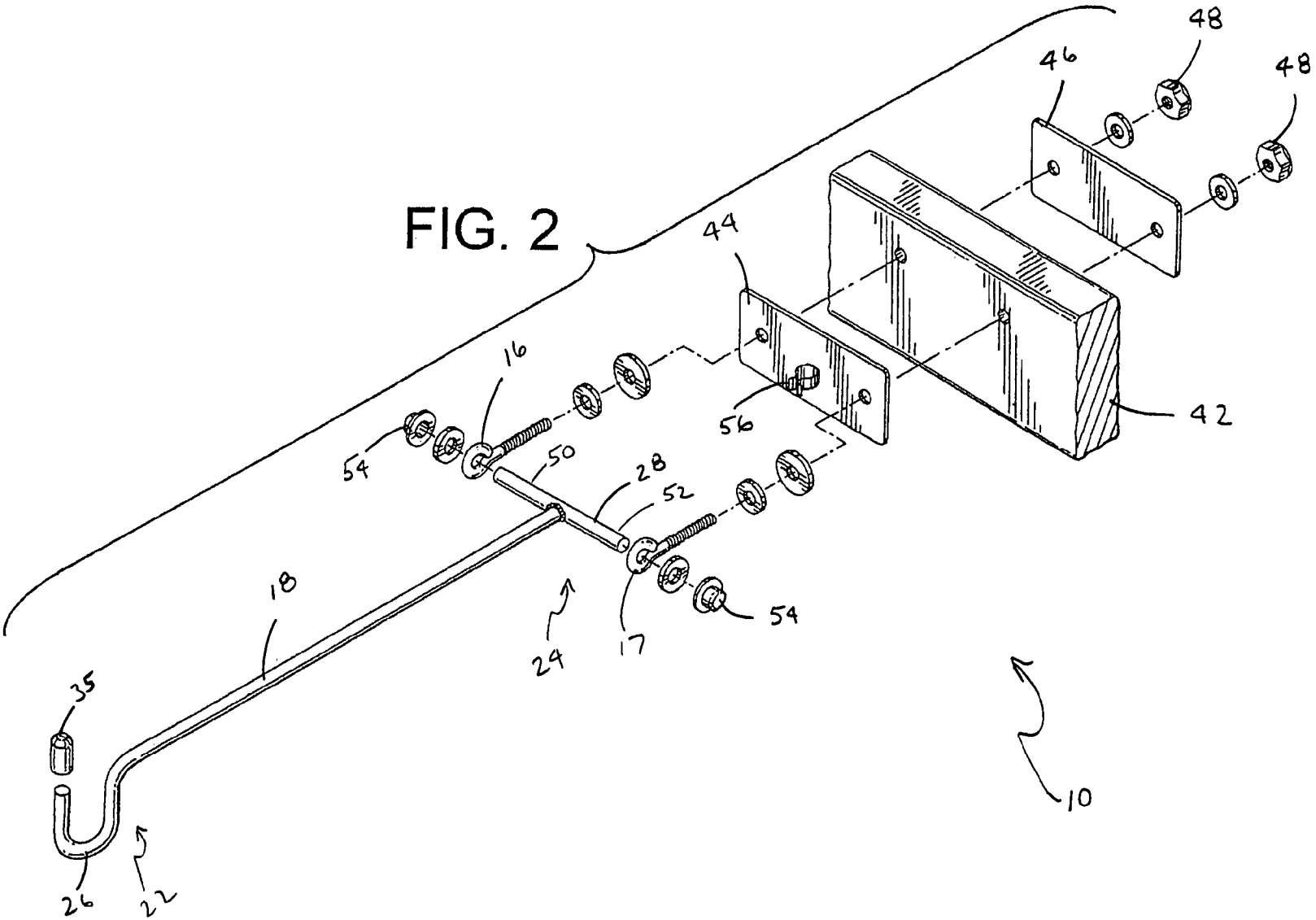
FIG. 2 is an exploded perspective view of the golf bag support.

Referring to the figures, and specifically to FIGS. 1 and 2, there is shown a golf bag support 10 for supporting a golf bag 12 in a golf cart 14. The golf bag support 10 generally comprises a connector 16 and an elongated arm 18. The elongated arm 18 rotates or hinges about the connector 16 from a first or stowed position, shown in FIG. 1 and in phantom lines in FIG. 4, to a second or use position, shown in FIGS. 3 and 4. Further, it is understood, that the elongated arm 18 can rotate through a variety of positions (i.e., from the first position to and beyond the second position), and that the second or use position is not a fixed position, but rather depends on several factors such as the height of the golf bag 12 and the position of the bottom of the golf bag 12 in the golf cart 14. Additionally, the length of the elongated arm 18 may affect the angle at which the elongated arm 12 is positioned when it engages the golf bag 12.

As shown in FIG. 2, in a preferred embodiment the elongated arm 18 is supported by a first connector 16 and a second connector 17. The second connector 17 is generally positioned distal the first connector 16. Additionally, the first and second connectors 16, 17 are utilized to not only support the elongated arm 18, but to provide a means by which the elongated arm 18 can both be supported and rotate from at least the first position to the second position to support the golf bag 12. In a preferred embodiment, the first and second connectors 16, 17 comprise eye bolts. As such, the first and second connectors 16, 17 both have an opening 20 to allow a portion of the elongated arm 18 (described in more detail below) to be rotatably supported.

The elongated arm 18 has a distal end 22 and an opposing proximal end 24. In a preferred embodiment a hook 26 extends from the distal end 22 of the elongated arm 18, and a transverse member 28 extends from the proximal end 24 of the elongated arm 18. In this embodiment the transverse member 28 is generally the portion of the elongated arm 18 that is rotatably supported by the first and second connectors 16, 17. Referring to the figures, the transverse member 28 may comprise a "T" shaped bar to provide rigidity to the golf bag support 10 and to assist in utilizing two connectors 16, 17 for rotational support. In manufacturing the preferred embodiment of the elongated arm 18, the arm 18 is made of a 0.25" diameter round stock material which is bent at the distal end 22 to form the hook 26. The proximal end 24 of the arm 18 is connected to the transverse member 28, which is also preferably made of the same round stock, preferably by welding. As such, the transverse member 28 operates as a rotational shaft for the elongated arm 18.

The elongated arm 18, including the transverse member 28 thereof, may be made of any sufficiently strong material, including steel, aluminum, plastic, etc. In the embodiment illustrated in the figures, the elongated arm 18 is made of 0.25" diameter steel. The elongated arm 18 also has a length between its distal end 22 and its proximal end 24. In one embodiment, the arm 18 is approximately 13 to 14 inches long, however it is understood that the arm 18 may be shorter or longer depending on the location where the arm 18 is connected to the golf cart 14, the size of the golf bag 12, and the location on the golf bag 12 where the arm 18 is connected to the bag 12.

Figure 3:
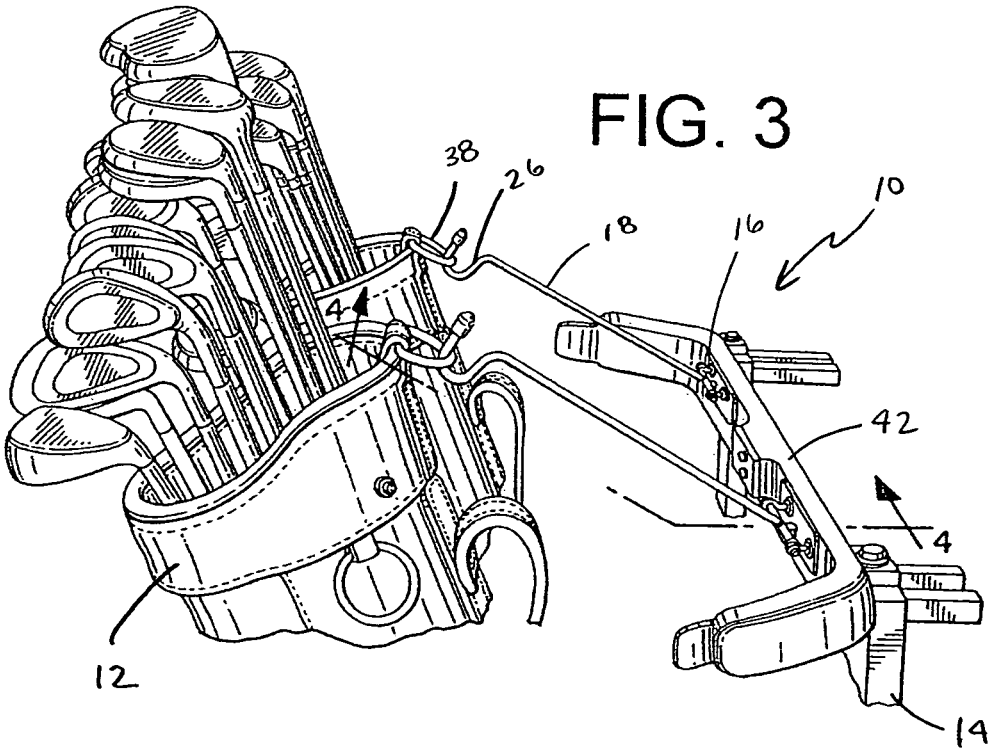
FIG. 3 is a side perspective view of the golf bag support connected to a golf bag.
Figures 4, 5, 6:
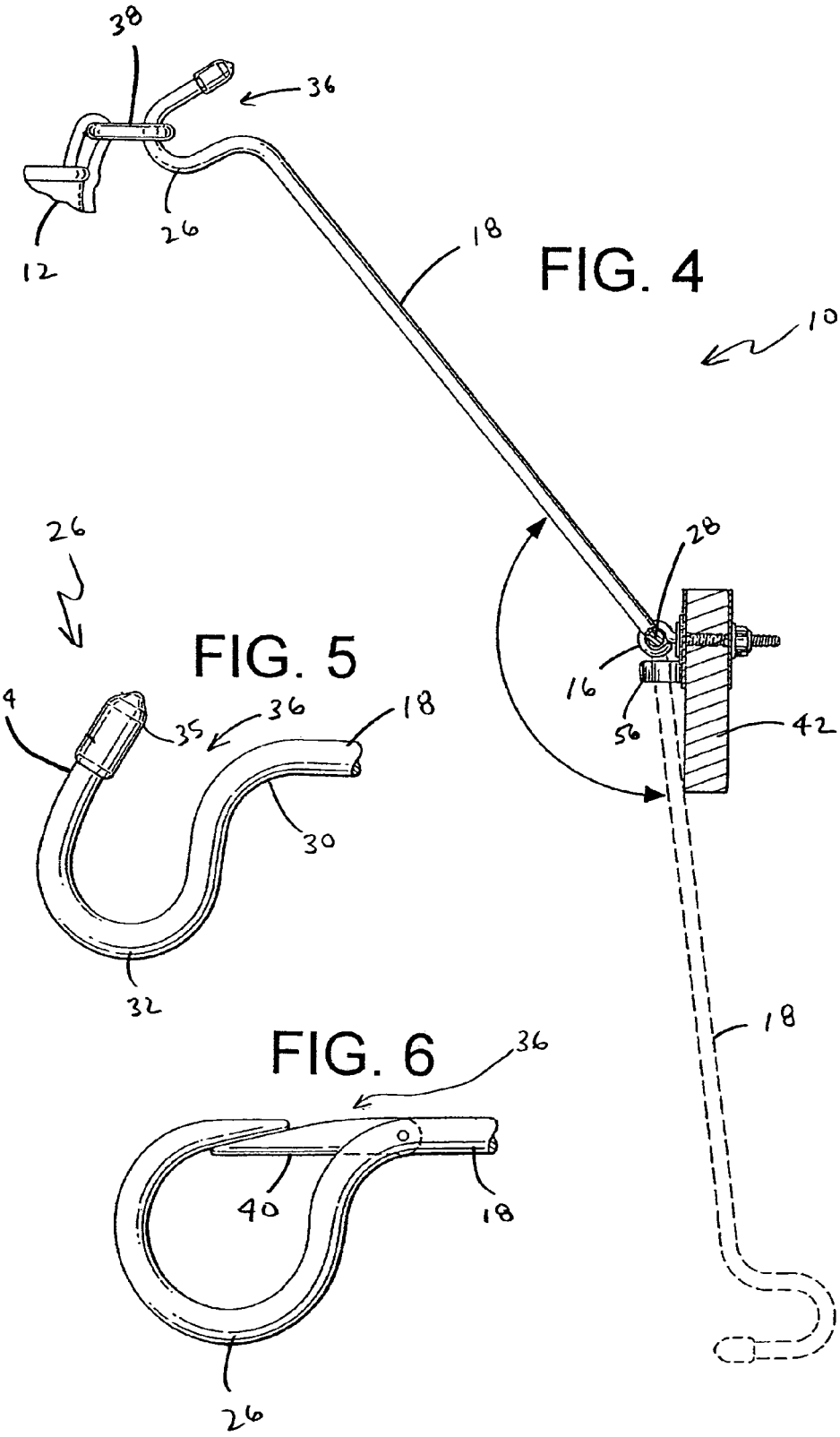
FIG. 4 is a side cross-sectional elevation view taken about line 4-4 of FIG. 3.
FIG. 5 is a side elevation view of another embodiment of a hook for the golf bag support; and, FIG. 6 is a side elevation view of another embodiment of a hook for the golf bag support.

The hook 26 of the elongated arm 18 is adapted to secure the golf bag 12 so that the bag 12 can be supported at an angle in the golf cart 14 to aid in the removal and insertion of golf clubs in the golf bag 12. As shown in FIGS. 4 and 5, the hook 26 may have a first arcuate or transverse portion 30, a second arcuate or transverse portion 32, and possibly a third arcuate portion 34. The first arcuate or transverse portion 30 extends in a first direction transverse to the elongated arm 18, the second arcuate or transverse portion 32 extends from the first arcuate portion 30 in a second opposing direction, and the third portion 34 of the hook 26 generally extends from the second portion 32. In a preferred embodiment, the first arcuate portion 30 extends at an angle of approximately between 10 to 45° from the body of the elongated arm 18. The third arcuate portion 34 may extend in a direction toward the body of the elongated arm 18 (as shown in FIG. 5), or in a direction generally perpendicular to the body of the elongated arm 18 (as shown in FIGS. 3 and 4). In a preferred embodiment, the third arcuate portion 34 is provided at an angle of approximately between 10 to 45° with respect to a vertical axis and toward the body of the elongated arm 18. A plastic or rubber plug 35 may be provided on the end of the hook 26 as a safety feature.

The hook 26 has an opening 36 though which the strap ring 38, or other component, of the golf bag 12 is inserted. After the strap ring 38 of the golf bag 12 is inserted through the opening 36 of the hook 26, the ring 38 is generally retained and secured by the hook 26 to maintain the golf bag 12 at an angle in the cart 14, thereby exposing the golf clubs in the bag 12 in a more direct manner for the user to remove and replace the golf clubs in the bag with relative ease.

Referring to FIG. 6, a latch 40 may be provided in an embodiment of the golf bag support 10. The latch 40 is generally provided in association with the hook 26. The latch 40 closes the opening 36 of the hook 26 to assist in retaining the golf bag 12 connected to the hook 26 of the elongated arm 18. The latch 40 is generally moveable from a first position, wherein the opening 36 to the hook 26 is open, to a second position, wherein the opening 36 to the hook 26 is closed (as shown in FIG. 6) to retain the golf bag 12. In an alternate embodiment, the latch 40 may be automatically closable. In such an embodiment the latch 40 may be provided with a spring or other available element (not shown) which applies a force on the latch 40 to maintain the latch 40 in the second position. The spring force, however, may be easily overcome by the user to insert and remove the strap ring 38 from the hook 26 so as to disengage the arm 18 from the golf bag 12.

As shown in FIGS. 1, 2 and 4, the golf bag support 10 is preferably mounted to an existing bag holder 42 of the golf cart 14. To aid in mounting the golf bag support 10 to the bag holder 42, two brackets 44, 46 are utilized. The brackets 44, 46 operate essentially as mounting plates for the bag support 10. The first bracket 44 is positioned on a first side or surface of the bag holder 42, and the second bracket 46 is positioned on a second side or surface of the bag holder 42. The connectors 16, 17 may extend from and/or through the first bracket 44. In a preferred embodiment, as shown in the exploded view of FIG. 2, the first connector 16 is an eye bolt that extends through an aperture in the first bracket 44, through an aperture in the existing bag holder 42, and through an aperture in the second bracket 46. Similarly, the second connector 17 is an eye bolt that extends through an aperture in the first bracket 44, through an aperture in the existing bag holder 42, and through an aperture in the second bracket 46. Retaining nuts 48 are positioned on the opposing side of the second bracket 46 to retain the connectors 16, 17 in place.

The transverse member 28 has a first portion 50 that extends through and is rotatably secured by the first connector 16, and a second opposing portion 52 that extends through and is secured by the second connector 17. The ends of the first and second portions 50, 52 of the transverse member 28 typically extend beyond the connectors 16, 17 to allow retainers 54 to be utilized to maintain the transverse member 28 accurately positioned and secured in place. More specifically, a first retainer 54 is provided on the transverse member 28 adjacent the first connector 16, and a second retainer 54 is provided on the transverse member 28 adjacent the second connector 17. The retainers 54 allow the transverse member 28 to rotate in the connectors 16, 17, but they generally prevent unwanted lateral movement by the arm 18.

Referring to FIGS. 1, 2 and 4, the golf bag support 10 may also be provided with a coupling 56. The coupling 56 is utilized to releasably secure the arm 18 in the first position as shown in FIG. 1 and in phantom in FIG. 4. In a preferred embodiment, the coupling 56 comprises either a plastic or metal spring member that extends from the bracket 44. The coupling 56 engages the elongated arm 18 in the first position to secure the elongated arm during periods of non-use of the golf bag support 10.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first", "second," and "third" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A golf bag support for supporting a golf bag in a golf cart, the assembly comprising:

a first and second eye bolt connector attached to a bracket for mounting to a portion of the golf cart, the bracket comprised of first and second mounting plates wherein the first plate is adjustable relative to the second mounting plate;

an elongated arm having a transverse member connected at one end thereof and the other end of the elongated arm integrally forming a hook having first, second and third arcuate portions and an opening between the first and third arcuate portions, the first arcuate portion extending at an angle of approximately between 10° and 45° from the elongated arm and the third arcuate portion forming an angle between approximately 10° and 45° with respect to a vertical axis in order to secure the golf bag in an angular position opposite the bag holder;

the transverse member having a width greater than a width of the elongated arm and being rotatably supported by the first and second eye bolt connectors such that the support has a first stowed position wherein the elongated arm is positioned below a horizontal plane extending along a longitudinal axis of the first and second eye bolt connectors and a second use position wherein the elongated arm is positioned above the horizontal plane extending along the longitudinal axes of the first and second eye bolt connectors;

wherein an angle greater than 90° and less than 180° is formed between the elongated arm in the first position and the elongated arm in the second position, and wherein an angle of less than 90° is formed between the horizontal plane and the elongated arm in the second position and wherein an angle of greater than 90° is formed between the horizontal plane and the elongated arm in the first position; and a coupling connected to the bracket below the first and second eye bolt connectors, the coupling comprised of a first flexible member and an opposing second flexible member that is configured to releasably engage the elongated arm between the first and second flexible members in the first stowed position.

2. The golf bag support of claim 1, wherein the support is maintained in the second use position only by the golf bag attached to the support.

3. The golf bag support of claim 1, wherein the third arcuate portion of the hook is angled toward the elongated arm.

4. The golf bag support of claim 1, wherein the coupling engages the elongated arm adjacent the transverse member.

5. The golf bag support of claim 1, wherein the elongated arm is a steel rod having a diameter of approximately 0.25 inches.

6. The golf bag support of claim 1, wherein the elongated arm has a length between approximately 13 and 18 inches.

7. A golf bag support for supporting a golf bag in a golf cart having a golf bag holder, the support consisting essentially of:

a bracket configured for securable connection to the golf bag holder;

a connector attached to the bracket, wherein the connector is comprised of first and second eye bolts;

an elongated arm having a proximal end and a distal end, the distal end of the elongated arm forming an integral hook for securing the golf bag in an angular position opposite the golf bag holder;

a transverse member connected to the proximal end of the elongated arm, the transverse member having a width greater than a width of the elongated arm to form a T-shaped bar, the transverse member being rotatably supported by the connector such that the elongated arm is rotatable between a first stowed position wherein the elongated arm is positioned below a horizontal plane extending along a longitudinal axis of the connector and forms an angle greater than 90° with the horizontal plane and a second use position above the horizontal plane wherein the hook engages the golf bag; and a coupling connected to the bracket below the connector and configured to releasably engage the elongated arm in the first stowed position, wherein the bracket is comprised of first and second mounting plates.

8. The golf bag support of claim 7, wherein the integral hook is comprised of first, second and third arcuate portions, the first arcuate portion extending at an angle of between 10° and 45° from the elongated arm and the third arcuate portion extending toward the elongated arm.

9. The golf bag support of claim 7, wherein the elongated arm is free to rotate from a substantially vertical position wherein the hook is positioned below the horizontal plane and a substantially vertical position wherein the hook is positioned above the horizontal plane.

10. A golf bag support for supporting a golf bag in a golf cart having a golf bag holder, the support comprising:

a connector;

an elongated arm having first and second ends, a transverse member connected at the first end of the elongated arm and the second end of the elongated arm integrally forming a hook having first, second and third arcuate portions and an opening between the first and third arcuate portions, the third arcuate portion forming an angle between approximately 10° and 45° with respect to a vertical axis and toward the elongated arm in order to secure the golf bag in an angular position opposite the golf bag holder;

the transverse member having a width greater than a width of the elongated arm and being rotatably supported by the connector such that the elongated arm has a first stowed position wherein the elongated arm is positioned below a horizontal plane extending along a longitudinal axis of the connector and a second use position wherein the elongated arm is positioned above the horizontal plane extending along the longitudinal axis of the connector;

wherein an angle greater than 90° and less than 180° is formed between the elongated arm in the first position and the elongated arm in the second position, and wherein an angle of less than 90° is formed between the horizontal plane and the elongated arm in the second position and wherein an angle of greater than 90° is formed between the horizontal plane and the elongated arm in the first position; and a coupling positioned below the connector and comprised of a first flexible member and an opposing second flexible member that is configured to releasably engage the elongated arm between the first and second flexible members in the first stowed position.

11. The golf bag support of claim 10, wherein the support is free from a connection that maintains the elongated arm in the second use position.

* * * * *